US011731131B2

(12) United States Patent
Li

(10) Patent No.: US 11,731,131 B2
(45) Date of Patent: Aug. 22, 2023

(54) METHOD AND DEVICE FOR DRIVING MICROFLUIDIC CHIP, AND MICROFLUIDIC SYSTEM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventor: Chengqian Li, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 481 days.

(21) Appl. No.: 16/957,429

(22) PCT Filed: Dec. 23, 2019

(86) PCT No.: PCT/CN2019/127593

§ 371 (c)(1),
(2) Date: Jun. 24, 2020

(87) PCT Pub. No.: WO2020/155933

PCT Pub. Date: Aug. 6, 2020

(65) Prior Publication Data

US 2021/0229089 A1 Jul. 29, 2021

(30) Foreign Application Priority Data

Jan. 31, 2019 (CN) ..... 201910098039.4

(51) Int. Cl.
*B01L 3/00* (2006.01)

(52) U.S. Cl.
CPC ..... *B01L 3/50273* (2013.01); *B01L 3/502715* (2013.01); *B01L 3/502784* (2013.01);
(Continued)

(58) Field of Classification Search
CPC ..... B01L 3/50273; B01L 3/502715; B01L 3/502784; B01L 2300/0816;
(Continued)

(56) References Cited

U.S. PATENT DOCUMENTS 8,252,159 B2 * 8/2012 Roux ..... F04B 19/006 204/450
2012/0014192 A1 1/2012 Patil et al.
(Continued)

FOREIGN PATENT DOCUMENTS

CN 102340303 A 2/2012
CN 105467707 A 4/2016
(Continued)

OTHER PUBLICATIONS

International search report of PCT application No. PCT/CN2019/127593 dated Mar. 27, 2020.
(Continued)

*Primary Examiner* — Christine T Mui
(74) *Attorney, Agent, or Firm* — Lippes Mathias LLP

(57) ABSTRACT

The present disclosure discloses a method for driving a microfluidic chip including: controlling a first electrode that currently carries a droplet to be electrically connected to a first power supply by a first switch circuit connected to the first electrode; after controlling the first electrode to be in electrical connection to the first power supply for a first period of time, controlling the first electrode to be in electrical connection to a second power supply for a second period of time; and after the second period of time, continuing to control the first electrode to keep disconnected from two power supplies.

20 Claims, 4 Drawing Sheets

(52) U.S. Cl.
CPC ..... *B01L 2300/0816* (2013.01); *B01L 2400/0415* (2013.01)

(58) Field of Classification Search
CPC ..... B01L 2400/0415; B01L 2400/0427; B01L 3/502792
USPC ..... 422/504, 500
See application file for complete search history.

(56) References Cited

U.S. PATENT DOCUMENTS

| | | | | |
|---|---|---|---|---|
| 2014/0054174 | A1 | 2/2014 | Wang | |
| 2016/0318038 | A1 | 11/2016 | Short et al. | |
| 2018/0088420 | A1 | 3/2018 | Hao et al. | |
| 2021/0362148 | A1* | 11/2021 | Long | B01L 3/502792 |

FOREIGN PATENT DOCUMENTS

| | | | |
|---|---|---|---|
| CN | 107617451 | A | 1/2018 |
| CN | 109126917 | A | 1/2019 |
| CN | 109174219 | A | 1/2019 |
| CN | 109622085 | A | 4/2019 |
| WO | WO2014031896 | A1 | 2/2014 |
| WO | WO2014074367 | A1 | 5/2014 |

OTHER PUBLICATIONS

First office action of Chinese application No. 201910098039.4 dated Apr. 1, 2020.

* cited by examiner

METHOD AND DEVICE FOR DRIVING MICROFLUIDIC CHIP, AND MICROFLUIDIC SYSTEM

CROSS REFERENCE TO RELATED APPLICATION

This present disclosure is a 371 of PCT/CN2019/127593, filed on Dec. 23, 2019, which claims priority to Chinese Patent Application No. 201910098039.4, filed on Jan. 31, 2019 and entitled "METHOD AND DEVICE FOR DRIVING MICROFLUIDIC CHIP AND MICROFLUIDIC SYSTEM", the entire contents of which are incorporated herein by reference.

TECHNICAL FIELD

The present disclosure relates to the field of biochemical technology, and in particular to a method and device for driving a microfluidic chip, and a microfluidic system.

BACKGROUND

Digital microfluidic technology is a technology that uses a device for driving a microfluidic chip to realize preparation, detection, reaction and separation of droplet samples on the microfluidic chip.

SUMMARY

The present disclosure provides a method and device for driving a microfluidic chip, and a microfluidic system. The technical solution is as follows.

In one aspect, a method for driving a microfluidic chip is provided. The method is applicable to a device for driving a microfluidic chip, wherein the microfluidic chip includes a droplet and a plurality of electrodes; the device includes a plurality of switch circuits one-to-one corresponding to the plurality of electrodes, each of the switch circuits having an input connected to the electrode corresponding to the switch circuit, and outputs connected to a first power supply and a second power supply respectively; and the method includes:

controlling, by a first switch circuit in the plurality of switch circuits, a first electrode connected to the first switch circuit to be electrically connected to the first power supply, the first electrode being an electrode currently carrying the droplet;

after controlling the first electrode to be in electrical connection to to the first power supply for a first period of time, controlling, by the first switch circuit, the first electrode to be electrically connected to the second power supply and controlling, by a second switch circuit connected to a second electrode, the second electrode to be electrically connected to the first power supply, such that the droplet moves onto the second electrode, the second electrode being an electrode adjacent to the first electrode; and after controlling the first electrode to be in electrical connection to to the second power supply for a second period of time, controlling, by the first switch circuit, the first electrode to keep disconnected from two power supplies, the two power supplies being the first power supply and the second power supply respectively.

Optionally, a period of time within which the first electrode maintains disconnection from the two power supplies is longer than the second period of time.

Optionally, each of the switch circuits is a tri-state switch, the outputs of each of the switch circuits including a first output, a second output and a third output, wherein the first output is connected to the first power supply, the second output is connected to the second power supply, and the third output is idle;

controlling, by the first switch circuit in the plurality of switch circuits, the first electrode connected to the first switch circuit to be electrically connected to the first power supply includes:

controlling an input of the first switch circuit to be electrically connected to the first output of the first switch circuit;

controlling, by the first switch circuit, the first electrode to be electrically connected to the second power supply includes:

controlling the input of the first switch circuit to be electrically connected to the second output of the first switch circuit; and controlling, by the first switch circuit, the first electrode to keep disconnected from the two power supplies includes:

controlling the input of the first switch circuit to be electrically connected to the third output of the first switch circuit.

Optionally, the device for driving the microfluidic chip further includes a drive circuit connected to each of the switch circuits; and controlling the input of the first switch circuit to be electrically connected to the first output of the first switch circuit includes:

outputting a first control signal to the first switch circuit by the drive circuit, such that the input of the first switch circuit is electrically connected to the first output of the first switch circuit.

Optionally, controlling the input of the first switch circuit to be electrically connected to the second output of the first switch circuit includes:

outputting a second control signal to the first switch circuit by the drive circuit, such that the input of the first switch circuit is electrically connected to the second output of the first switch circuit.

Optionally, controlling the input of the first switch circuit to be electrically connected to the third output of the first switch circuit includes:

outputting a third control signal to the first switch circuit by the drive circuit, such that the input of the first switch circuit is electrically connected to a third output of the first switch circuit.

Optionally, the device for driving the microfluidic chip includes an upper computer connected to the drive circuit, the upper computer sending drive sequence information to the drive circuit, and the drive sequence information indicating a drive sequence of the plurality of electrodes.

Optionally, a period of time within which the first electrode maintains disconnection from the two power supplies is longer than the first period of time.

Optionally, the first power supply is an AC power supply, and the second power supply is ground.

Optionally, a period of time within which the first electrode maintains disconnection from the two power supplies is longer than the second period of time;

each of the switch circuits is a tri-state switch, and the outputs of each of the switch circuits include a first output, a second output and a third output, the first output being connected to the first power supply, the second output being connected to the second power supply, and the third output being idle;

controlling, by the first switch circuit in the plurality of switch circuits, the first electrode connected to the first switch circuit to be electrically connected to the first power supply includes:

controlling an input of the first switch circuit to be electrically connected to the first output of the first switch circuit;

controlling, by the first switch circuit, the first electrode to be electrically connected to the second power supply includes:

controlling the input of the first switch circuit to be electrically connected to the second output of the first switch circuit;

controlling, by the first switch circuit, the first electrode to keep disconnected from the two power supplies includes:

controlling the input of the first switch circuit to be electrically connected to the third output of the first switch circuit;

the device for driving the microfluidic chip further includes a drive circuit connected to each of the switch circuits;

controlling the input of the first switch circuit to be electrically connected to the first output of the first switch circuit includes:

outputting a first control signal to the first switch circuit by the drive circuit, such that the input of the first switch circuit is electrically connected to the first output of the first switch circuit;

controlling the input of the first switch circuit to be electrically connected to the second output of the first switch circuit includes:

outputting a second control signal to the first switch circuit by the drive circuit, such that the input of the first switch circuit is electrically connected to the second output of the first switch circuit; and controlling the input of the first switch circuit to be electrically connected to the third output of the first switch circuit includes:

outputting a third control signal to the first switch circuit by the drive circuit, such that the input of the first switch circuit is electrically connected to the third output of the first switch circuit.

In another aspect, a device for driving a microfluidic chip is provided. The microfluidic chip includes a droplet and a plurality of electrodes; the device includes a plurality of switch circuits one-to-one corresponding to the plurality of electrodes;

each of the switch circuits has an input connected to the electrode corresponding to the cswitch circuit, and outputs connected to a first power supply and a second power supply respectively; and each of the switch circuits is configured to control a electrode connected thereto to be electrically connected to the first power supply or the second power supply, or is configured to control a electrode connected thereto to keep disconnected from the first power supply and the second power supply.

Optionally, each of the switch circuits is a tri-state switch, the outputs of each of the switch circuits including a first output, a second output and a third output, wherein the first output is connected to the first power supply, the second output is connected to the second power supply, and the third output is idle.

Optionally, the device for driving the microfluidic chip further includes a drive circuit connected to each of the switch circuits, wherein the drive circuit is configured to output a first control signal, a second control signal or a third control signal to each of the switch circuits, the first control signal being configured to instruct the switch circuit to electrically connect the input of the switch circuit with the first output of the switch circuit, the second control signal being configured to instruct the switch circuit to electrically connect the input of the switch circuit with the second output of the switch circuit, and the third control signal being configured to instruct the switch circuit to electrically connect the input of the switch circuit with the third output of the switch circuit.

Optionally, the drive circuit is a single-chip microcomputer.

Optionally, the device for driving the microfluidic chip further includes an upper computer connected to the drive circuit, wherein the upper computer sends drive sequence information to the drive circuit, and the drive sequence information indicates a drive sequence of the plurality of electrodes.

Optionally, each of the switch circuits is a tri-state switch, the outputs of each of the switch circuits include a first output, a second output and a third output, the first output being connected to the first power supply, the second output being connected to the second power supply, and the third output being idle;

the device further includes a drive circuit connected to each of the switch circuits, and the drive circuit is a single-chip microcomputer; wherein the drive circuit is configured to output a first control signal, a second control signal or a third control signal to each of the switch circuits, the first control signal being configured to instruct the switch circuit to electrically connect the input of the switch circuit with the first output of the switch circuit, the second control signal being configured to instruct the switch circuit to electrically connect the input of the switch circuit with the second output of the switch circuit, and the third control signal being configured to instruct the switch circuit to electrically connect the input of the switch circuit with the third output of the switch circuit.

In another aspect, a microfluidic system is provided. The system includes a microfluidic chip and the device for driving the microfluidic chip aforesaid.

BRIEF DESCRIPTION OF THE DRAWINGS

In order to describe the technical solutions in the embodiments of the present more clearly, the following briefly introduces the accompanying drawings required for describing the embodiments.

Apparently, the accompanying drawings in the following description show merely some embodiments of the present disclosure, and a person of ordinary skill in the art may also derive other drawings from these accompanying drawings without creative efforts.

DETAILED DESCRIPTION

Embodiments of the present disclosure will be described below with reference to the drawings.

Digital microfluidic technology is a technology that provides voltages to electrodes disposed on a microfluidic chip using a device for driving the microfluidic chip to drive a droplet on an electrode to move so as to automatically realize preparation, detection, reaction and separation of the droplet sample.

Figure 1:
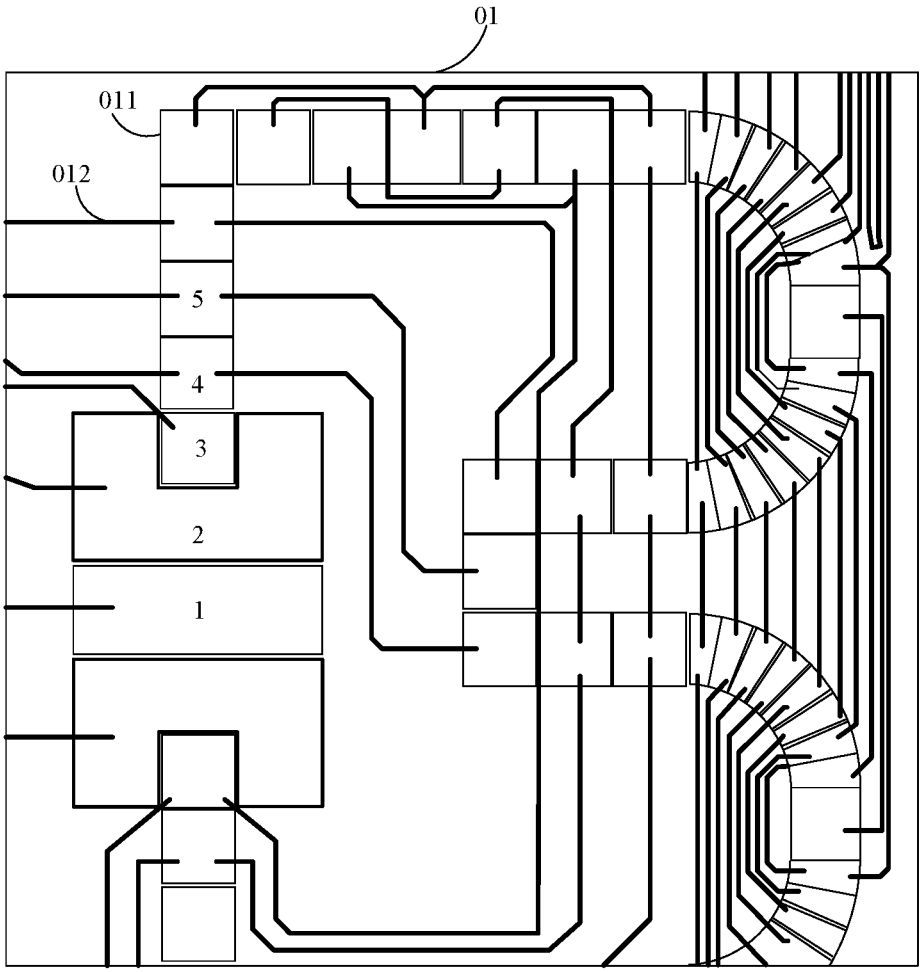
FIG. 1 is a schematic structural diagram of a microfluidic chip in accordance with an embodiment of the present disclosure.

FIG. 1 is a schematic structural diagram of a microfluidic chip in accordance with an embodiment of the present disclosure. As shown in FIG. 1, the microfluidic chip 01 may include a plurality of electrodes 011 and a plurality of signal lines 012. Each signal line 012 may be connected to one electrode 011. The plurality of electrodes 011 may be in the same or different shape(s).

Exemplarily, as shown in FIG. 1, the plurality of electrodes 011 may include not only a rectangular electrode and a fan-shaped electrode, but also a concave electrode, and the rectangular electrode adjacent to the concave electrode may be disposed in a concave region of the concave electrode. For example, referring to FIG. 1, the No. 2 electrode is a concave electrode, the No. 3 electrode is a rectangular electrode, and the No. 3 electrode is disposed in the concave region of the No. 2 electrode.

In the related art, the microfluidic chip includes a substrate, as well as a plurality of electrodes, hydrophobic layers and spherical droplets, which are sequentially disposed on the substrate. The device for driving the microfluidic chip includes a plurality of switch circuits. For each switch circuit, its input connected to one electrode and its outputs connected to an AC power supply and ground respectively. The device may control a target electrode to be electrically connected to the AC power supply by a target switch circuit connected to the target electrode currently carrying droplets, such that the target electrode stretches the spherical droplets to be flat. After controlling the target electrode to be in electrical connection to the AC power supply for a preset period of time, the device may control the target electrode to be electrically connected to the ground to release charges by the target switch circuit.

In the related art, each switch circuit included in a device for driving a microfluidic chip may be a two-state switch (for example, a relay switch). That is, each switch circuit may include one input and two outputs. The input may be connected to a same electrode, and the two outputs may be respectively connected to an AC power supply for providing positive voltage and ground. When the droplet is driven to move, the device may control the input of a target switch circuit connected to a target electrode to be electrically connected to one output, such that the target electrode may be electrically connected to the AC power supply. After controlling the target electrode to be in electrical connection to the AC power supply for a certain period of time, the device may control the input of the target switch circuit to be electrically connected to the other output, such that the target electrode may be electrically connected to the ground to release charges. And at this time, the device may also control the input of a switch circuit connected to another electrode to be electrically connected to one output, such that the another electrode is electrically connected to the AC power supply.

However, in the related art, since one electrode of two adjacent electrodes is electrically connected to the AC power supply, the other electrode is electrically connected to the ground, and a potential difference between the two electrodes is significant, a high-voltage breakdown may occur. In addition, for the electrodes in special positions, for example, the adjacent No. 2 electrode and No. 3 electrode in FIG. 1, when the No. 3 electrode is electrically connected to the ground, and the No. 2 electrode is electrically connected to the AC power supply, charges released by the No. 3 electrode will adversely affect voltages on three sides (three sides adjacent to the No. 3 electrode of the No. 2 electrode) that surround the No. 3 electrode of the No. 2 electrode. The potential difference between the two electrodes is more significant, and as a result, a high-voltage breakdown is more likely to occur, leading to a relatively low yield of chips.

An embodiment of the present disclosure provides a method for driving a microfluidic chip and may solve the problem in the related art that a microfluidic chip is destroyed due to an electrode thereon is prone to a high-voltage breakdown. The method may be applicable to a device for driving a microfluidic chip and may drive a plurality of electrodes 011 included by the microfluidic chip shown in FIG. 1. Referring to FIG. 1, the microfluidic chip 01 may include a droplet (not shown in FIG. 1) and a plurality of electrodes 011 that may be disposed on a substrate.

Figure 2:
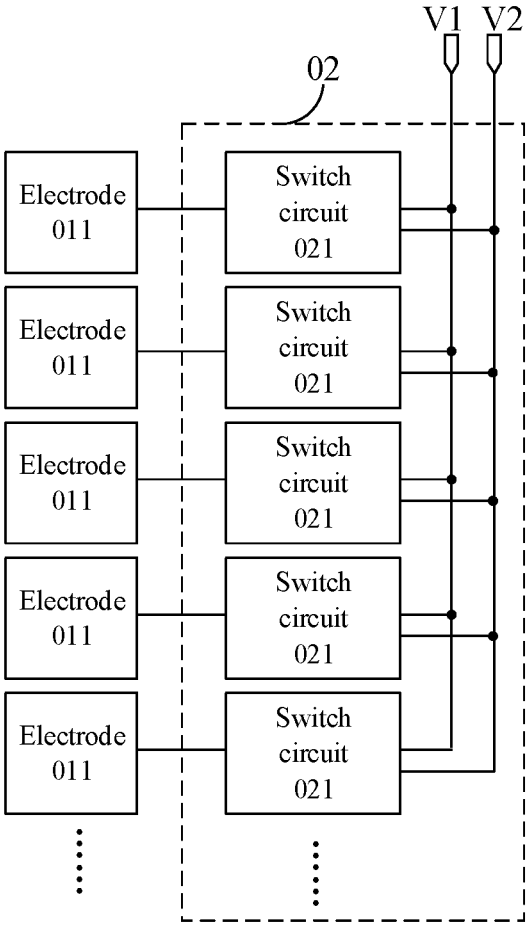
FIG. 2 is a schematic structural diagram of a device for driving a microfluidic chip in accordance with an embodiment of the present disclosure.

FIG. 2 is a schematic structural diagram of a device for driving a microfluidic chip in accordance with an embodiment of the present disclosure. As shown in FIG. 2, the device 02 may include a plurality of switch circuits 021 (FIG. 2 merely shows 5 electrodes 011 and 5 switch circuits 021 connected to the 5 electrodes one-to-one corresponding manner) corresponding to the plurality of electrodes 011. An input of each switch circuit 021 may be connected to an electrode 011 corresponding to each switch circuit 021, and outputs of each switch circuit 021 may be connected to a first power supply V1 and a second power supply V2 respectively.

Figure 3:
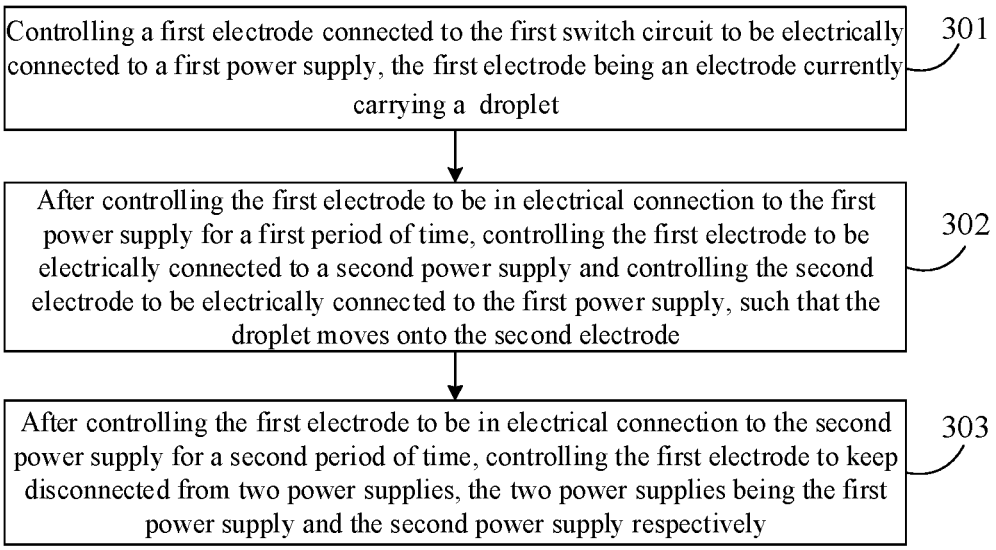
FIG. 3 is a schematic flowchart of a method for driving a microfluidic chip in accordance with an embodiment of the present disclosure.

FIG. 3 is a schematic flowchart of a method for driving a microfluidic chip in accordance with an embodiment of the present disclosure. The method may be applicable to the device for driving the microfluidic chip shown in FIG. 2. As shown in FIG. 3, the method may include the following steps.

In step 301, a first electrode connected to a first switch circuit is controlled to be electrically connected to a first power supply by the first switch circuit in the plurality of switch circuits. The first electrode is an electrode that currently carries the droplet.

When the device for driving the microfluidic chip starts to work, the first electrode may be controlled to be electrically connected to the first power supply by the first switch circuit connected to the first electrode that currently carries the droplet. At this time, the first electrode may stretch the spherical droplet to be flat under the control of a first power signal provided by the first power supply, and for example, it may break up one relatively big droplet into a plurality of relatively small droplets.

In step 302, after the first electrode is controlled to be in electrical connection to the first power supply for a first period of time, the first electrode is controlled to be electrically connected to a second power supply by the first switch circuit, and a second electrode is controlled to be electrically connected to the first power supply by a second switch circuit connected to the second electrode, such that the droplet moves onto the second electrode.

In the present embodiment, the second electrode may be an electrode adjacent to the first electrode. After the device controls the first electrode to be in electrical connection to the first power supply for the first period of time, it may continue to control, the first electrode to be electrically connected to the second power supply by the first switch circuit. At this time, the first electrode may release charges under the control of a second power signal provided by the second power supply. A potential of the second power signal may be a low potential relative to a potential of the first power signal.

In addition, the microfluidic chip further includes a hydrophobic layer disposed on the side, away from the substrate, of the plurality of electrodes, and the droplet may be disposed on the hydrophobic layer. After the first period of time, the device for driving the microfluidic chip may also control the second electrode to be electrically connected to the first power supply by the second switch circuit connected to the second electrode. When the voltage on the first electrode is gradually reduced, and the voltage on the second electrode adjacent to the first electrode is gradually increased, the hydrophobic layer may drive the droplet on the first electrode to move onto the second electrode under the action of the second electrode. That is, the second electrode may attract the droplet thereto.

In step 303, after the first electrode is controlled to be in electrical connection to the second power supply for a second period of time, the first electrode maintains disconnection from two power supplies by the first switch circuit. The two power supplies are the first power supply and the second power supply respectively.

In the present embodiment, the device for driving the microfluidic chip may continue to control the first electrode to keep disconnected from the first power supply and the second power supply by the first switch circuit, after controlling the first electrode to be in electrical connection to the second power supply for the second period of time. At this time, charges on the first electrode may not be released anymore, and part of unreleased charges may remain on the first electrode.

Optionally, the first period of time and the second period of time may be pre-configured before delivery of the device for driving the microfluidic chip, or may be preset by an operator according to actual conditions, which will not be limited in the embodiments of the present disclosure.

In summary, the embodiments of the present disclosure provide the method for driving the microfluidic chip. The method includes: controlling the first electrode that currently carries the droplet to be electrically connected to the first power supply by the first switch circuit connected to the first electrode; after controlling the first electrode to be in electrical connection to the first power supply for the first period of time, controlling the first electrode to be electrically connected to the second power supply for the second period of time; and after the second period of time, continuing to control the first electrode to keep disconnected from the two power supplies. The first electrode may be first controlled to be in electrical connection to the second power supply for the second period of time to release charges, and then, the first electrode maintains disconnection from the two power supplies, such that part of the charges may remain on the first electrode. Therefore, compared with methods in the related art, the method provided by the present disclosure can reduce a potential difference between two adjacent electrodes, thereby avoiding a high probability of high-voltage breakdown caused by a significant potential difference between the two adjacent electrodes.

Figure 4:
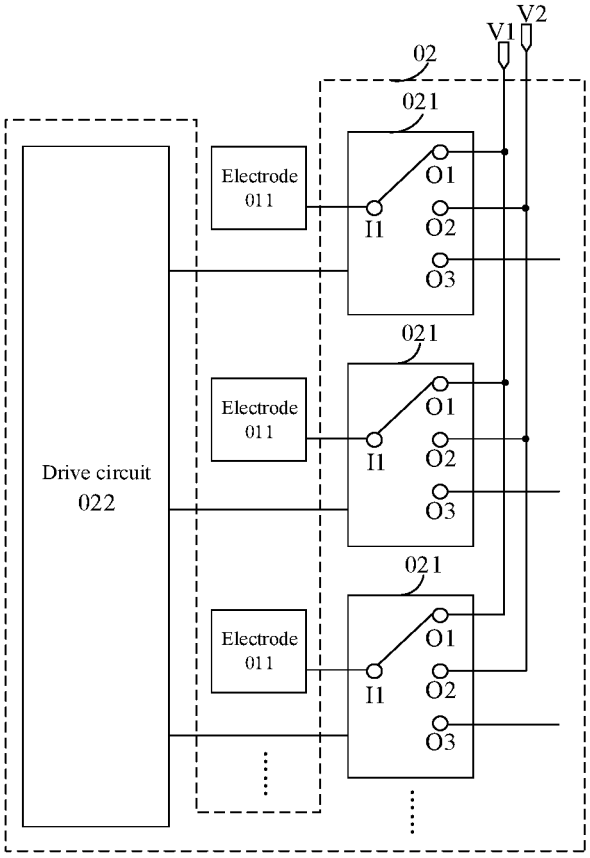
FIG. 4 is a schematic structural diagram of another device for driving a microfluidic chip in accordance with an embodiment of the present disclosure.

FIG. 4 is a schematic structural diagram of another driving device for driving a microfluidic chip in accordance with an embodiment of the present disclosure. As shown in FIG. 4, each switch circuit 021 may be a tri-state switch (FIG. 4 merely show 3 switch circuits 021, which is not limited by the present embodiment). Correspondingly, referring to FIG. 4, outputs of each switch circuit 021 may include a first output O1, a second output O2 and a third output O3. The device 02 for driving the microfluidic chip may further include a drive circuit 022.

The drive circuit 022 may be connected to each switch circuit 021. An input 11 of each switch circuit 021 may be connected to one corresponding electrode 011, the first output O1 of each switch circuit 021 may be connected to a first power supply V1, the second output O2 of each switch circuit 021 may be connected to a second power supply V2, and the third output O3 of each switch circuit 021 may be idle (not connected to any signal end or power supply).

Optionally, in an embodiment of the present disclosure, the first power supply V1 may be an AC power supply, and the second power supply V2 may be the ground. Moreover, a voltage of a first power signal provided by the first power supply V1 may be a relatively high positive voltage. For example, the voltage of the first power supply signal may be 150 volt(V).

Correspondingly, step 301 may include:

outputting a first control signal S1 to the first switch circuit 021 by the drive circuit 022, such that the input 11 of the first switch circuit 021 is electrically connected to the first output O1 of the first switch circuit 021. Further, the first switch circuit 021 controls the first electrode 011 to be electrically connected to the first power supply V1. The first electrode 011 may stretch the spherical droplet to be flat under the control of the first power signal.

Figure 5:
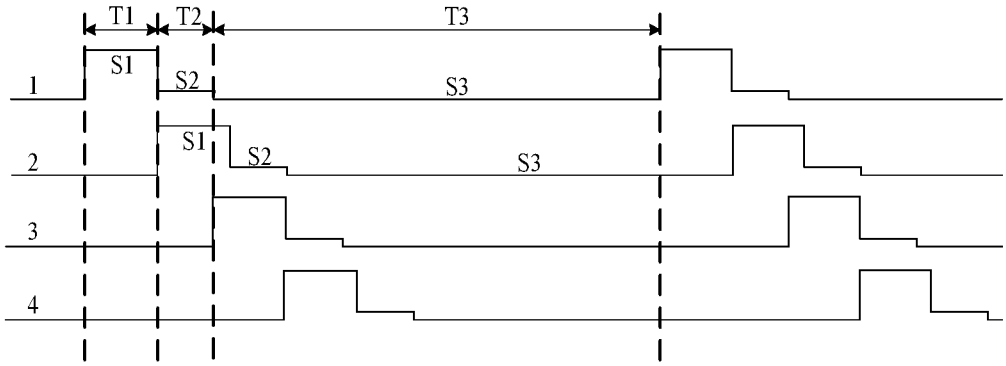
FIG. 5 is a timing sequence diagram of control signals sent by a driving circuit to an electrode in accordance with an embodiment of the present disclosure.

Exemplarily. FIG. 5 is a timing sequence diagram of control signals sent by a drive circuit to an electrode in accordance with an embodiment of the present disclosure. It is assumed that the first electrode 011 is the No. 1 electrode. Referring to FIG. 5, the device for driving the microfluidic chip may first output the first control signal S1 to the first switch circuit 021 by the drive circuit 022. At this time, referring to FIG. 6, the first switch circuit 021 may electrically connect its input I1 to its first output O1. Correspondingly, the first electrode 011 is electrically connected to the first power supply V1.

Correspondingly, step 302 may include:

after controlling the first electrode 011 to be in electrical connection to the first power supply V1 for a first period of time T1, outputting a second control signal S2 to the first switch circuit 021 by the drive circuit 022, such that the input 11 of the first switch circuit 021 is electrically connected to the second output O2 of the first switch circuit 021. Further, the first switch circuit 021 controls the first electrode 011 to be electrically connected to the second power supply V2. The first electrode 011 may release charges under the control of the second power signal.

Figure 7:
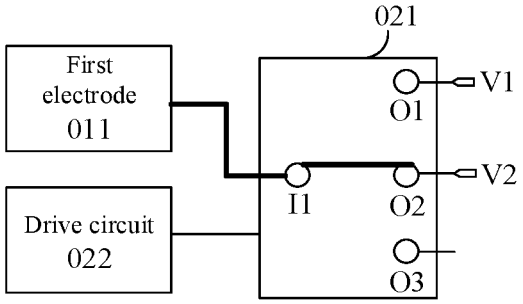
FIG. 7 is a schematic structural diagram of yet another device for driving a microfluidic chip in accordance with an embodiment of the present disclosure.

Exemplarily, as shown in FIG. 5, a duration within which the device for driving the microfluidic chip outputs the first control signal S1 to the first switch circuit 021 by the drive circuit 022 may be the first period of time T1. After the first period of time T1, the device for driving the microfluidic chip may continue to output the second control signal S2 to the first switch circuit 021 by the drive circuit 022. At this time, referring to FIG. 7, the first switch circuit 021 may electrically connect its input I1 to its second output O2. Correspondingly, the first electrode 011 is electrically connected to the second power supply V2.

Moreover, at this time, the device for driving the microfluidic chip may output the first control signal S1 to a second switch circuit 021 connected to a second electrode 011 by the drive circuit 022, such that the input 11 of the second switch circuit 021 is electrically connected to the first output O1 of the second switch circuit 021. Further, the second switch circuit 021 controls the second electrode 011 to be electrically connected to the first power supply V1. When a voltage on the second electrode 011 is gradually increased, and a voltage on the first electrode 011 is gradually reduced, the hydrophobic layer disposed on the plurality of electrodes 011 may drive the droplet on the first electrode 011 to move onto the second electrode 011. That is, the second electrode 011 may attract the droplet thereto.

Exemplarily, it is assumed that the second electrode 011 is the No. 2 electrode. Referring to FIG. 5, after the first period of time T1, the device for driving the microfluidic chip may simultaneously output the first control signal S1 to the second switch circuit 021 by the drive circuit 022. At this time, the second switch circuit 021 may electrically connect its input 11 to its first output 01. Correspondingly, the second electrode 011 may be electrically connected to the first power supply V1.

Correspondingly, step 303 may include:

after controlling the first electrode 011 to be in electrical connection to the second power supply V2 for a second period of time T2, continuing to output a third control signal S3 to the first switch circuit 021 by the drive circuit 022, such that the input 11 of the first switch circuit 021 is electrically connected to the third output O3 of the first switch circuit 021. Further, the first switch circuit 021 controls the first electrode 011 to keep disconnected from the two power supplies (the two power supplies are the first power supply V1 and the second power supply V2). As a result, the first electrode may not release charges anymore.

By controlling the first electrode to release the charges for the second period of time, the first electrode is continued to be controlled to keep disconnected from any one of the power supplies, such that part of the unreleased charges remain on the first electrode, and further, a potential difference between the first electrode and the adjacent second electrode is relatively small. Therefore, a high-voltage breakdown is avoided.

Figure 8:
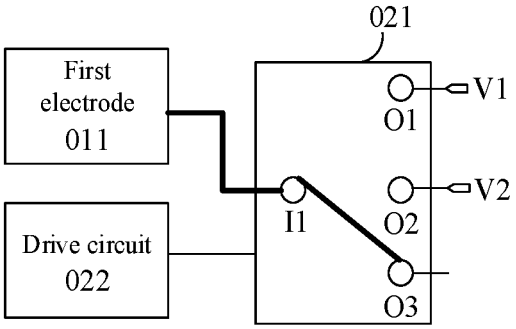
FIG. 8 is a schematic structural diagram of yet another device for driving a microfluidic chip in accordance with an embodiment of the present disclosure.

Exemplarily, as shown in FIG. 5, a duration within which the device for driving the microfluidic chip outputs the second control signal S2 to the first switch circuit 021 by the drive circuit 022 may be the second period of time T2. After the second period of time T2, the device for driving the microfluidic chip may continue to output the third control signal S3 to the first switch circuit 021 by the drive circuit 022. At this time, referring to FIG. 8, the first switch circuit 021 may electrically connect its input I1 to its third output O3. Correspondingly, the first electrode 011 maintains disconnection from both of the first power supply V1 and the second power supply V2. Referring to FIG. 5, a period of time within which the first electrode 011 maintains disconnection from the first power supply V1 and the second power supply V2 may be T3.

Optionally, the first period of time T1 and the second period of time T2 may be pre-configured before delivery of the device for driving the microfluidic chip, or may be preset by an operator according to actual conditions, which will not be limited in the embodiments of the present application. Besides, the period of time T3 within which the first electrode maintains disconnection from the two power supplies (the two power supplies are the first power supply and the second power supply) may be longer than the second period of time T2 and the first period of time T1.

Since the period of time within which the first electrode maintains disconnection from the two power supplies (the two power supplies are the first power supply and the second power supply) is longer than the second period of time (a period of time within which the first electrode is in electrical connection to the ground to release charges), as such, more charges will remain on the first electrode, and the first electrode releases less charges within the second period of time. Further, the potential difference between the two adjacent electrodes (e.g., the first electrode and the second electrode) is reduced, which in turn avoids a breakdown caused by a relatively significant potential difference, and effectively increases the yield of the microfluidic chips.

In an embodiment of the present disclosure, the device for driving the microfluidic chip may further include an upper computer (the upper computer may refer to a computer that may directly issue a control command). The drive circuit 022 may be connected to the upper computer which may send drive sequence information to the drive circuit 022. The drive sequence information may indicate a drive sequence of the plurality of electrodes 011. Correspondingly, the drive circuit 022 may sequentially and circularly output the first control signal S1 to the plurality of switch circuits 021 according to the drive sequence.

Exemplarily, it is assumed that for the microfluidic chip shown in FIG. 1, the drive sequence is from the No. 1 electrode to the No. 5 electrode. Referring to FIG. 5, the drive circuit 022 may output the first control signal S1 to the No. 1 to No. 5 electrodes (FIG. 5 merely shows the first control signal S1 output by the drive circuit 022 to the No. 1 to No. 4 electrodes, which will not be limited in the embodiments of the present disclosure). Besides, the second control signal S2 and the third control signal S3 may be sequentially output after the first control signal is output to each electrode.

In summary, the embodiment of the present disclosure provides the method for driving the microfluidic chip. The method includes: controlling the first electrode that currently carries the droplet to be electrically connected to the first power supply by the first switch circuit connected to the first electrode; after controlling the first electrode to be in electrical connection to the first power supply for the first period of time, controlling the first electrode to be in electrical connection to the second power supply for the second period of time; and after the second period of time, continuing to control the first electrode to keep disconnected from the two power supplies. The first electrode may be first controlled to be in electrical connection to the second power supply for the second period of time to release charges, and then, the first electrode maintains disconnection from the two power supplies, such that part of the charges may remain on the first electrode. Therefore, compared with methods in the related art, the method provided by the present disclosure can reduce a potential difference between two adjacent electrodes, thereby avoiding a high probability of high-voltage breakdown caused by a significant potential difference between the two adjacent electrodes.

An embodiment of the present disclosure further provides a device for driving a microfluidic chip. As shown in FIG. 1, the microfluidic chip 01 may include a droplet (not shown in FIG. 1) and a plurality of electrodes 011. As shown in FIG. 2 and FIG. 4, the device 02 for driving the microfluidic chip may include a plurality of switch circuits 021 one-to-one corresponding to the plurality of electrodes 011.

Referring to FIG. 2 and FIG. 4, each switch circuit 021 may have an input connected to one corresponding electrode 011, and outputs connected to a first power supply V1 and a second power supply V2 respectively. Each switch circuit 021 may be configured to control an electrode 011 connected thereto to be electrically connected to the first power supply V1 or the second power supply V2 or to keep disconnected from the first power supply V1 and the second power supply V2.

Optionally, in an embodiment of the present disclosure, the device for driving the microfluidic chip may control the first electrode that currently carries the droplet to be electrically connected to the first power supply by the first switch circuit connected to the first electrode. After controlling the first electrode to be in electrical connection to the first power supply for the first period of time, the device for driving the microfluidic chip may control the first electrode to be in electrical connection to the second power supply for the second period of time by the first switch circuit, such that the first electrode may release charges under the control of the second power signal provided by the second power supply. Moreover, after the second period of time, the device for driving the microfluidic chip may continue to control the first electrode to keep disconnected from the first power supply and the second power supply by the first switch circuit, such that the first electrode may not release the charges anymore, and part of the unreleased charges may remain on the first electrode. Since the charges remain on the first electrode, a potential difference between the first electrode and the adjacent second electrode may be reduced to avoid a high-voltage breakdown.

In summary, the present embodiment provides the device for driving the microfluidic chip, which may include the plurality of switch circuits. Since each switch circuit may control the electrode connected thereto to be electrically connected to the first power supply or the second power supply, or to keep disconnected from the first power supply and the second power supply, the charges may remain on one of the two adjacent electrodes, and further the potential difference between the two adjacent electrodes is reduced, thereby avoiding a high-voltage breakdown caused by a relatively significant potential difference at the junction of the two adjacent electrodes.

Optionally, it can be seen with reference to FIG. 4 that each switch circuit 021 may be a ti-state switch. Correspondingly, the outputs of each switch circuit 021 may include a first output O1, a second output O2 and a third output O3. In each switch circuit 021, the first output O1 may be connected to the first power supply V1, the second output O2 may be connected to the second power supply V2, and the third output O3 may be idle (not connected to any signal end or power supply).

Optionally, referring to FIG. 4, the device for driving the microfluidic chip may further include a drive circuit 022 connected to each switch circuit 021. The drive circuit 022 may be configured to sequentially output the first control signal S1, the second control signal S2 and the third control signal S3 to each switch circuit 021.

The first control signal S1 may be configured to instruct the switch circuit 021 to electrically connect its input I1 with its first output O1. The second control signal S2 may be configured to instruct the switch circuit 021 to electrically connect its input 11 with its second output O2. The third control signal S3 may be configured to instruct the switch circuit 021 to electrically connect its input I1 with its third output O3. Optionally, the drive circuit may be a single-chip microcomputer.

Figure 6:
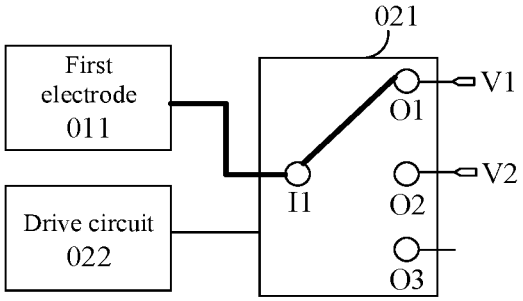
FIG. 6 is a schematic structural diagram of yet another device for driving a microfluidic chip in accordance with an embodiment of the present disclosure.

Exemplarily, it can be seen with reference to FIG. 5 and FIG. 6 that the first switch circuit 021 may electrically connect its input 11 with its first output O1 when the drive circuit 022 outputs the first control signal S1 to the first switch circuit 021. It can be seen with reference to FIG. 5 and FIG. 7 that the first switch circuit 021 may electrically connect its input I1 with its second output O2 when the drive circuit 022 outputs the second control signal S2 to the first switch circuit 021. It can be seen with reference to FIG. 5 and FIG. 8 that the first switch circuit 021 may electrically connect its input I1 to its third output O3 when the drive circuit 022 outputs the third control signal S3 to the first switch circuit 021.

In summary, the present embodiment provides the device for driving the microfluidic chip. The device for driving the microfluidic chip may include the plurality of switch circuits. Since each switch circuit may control the electrode connected thereto to be electrically connected to the first power supply or the second power supply, or to keep disconnected from the first power supply and the second power supply, the charges may remain on one of the two adjacent electrodes, and further the potential difference between the two adjacent electrodes is reduced, thereby avoiding a high-voltage breakdown caused by a relatively significant potential difference at the junction of the two adjacent electrodes.

In addition, an embodiment of the present disclosure further provides a microfluidic system, which may include the microfluidic chip shown in FIG. 1 and the device for driving the microfluidic chip shown in FIG. 2 or FIG. 4.

Those skilled in the art can clearly know that for the convenience and conciseness of description, the specific working processes of the device for driving the microfluidic chip and the microfluidic system described above may refer to the corresponding processes in the foregoing method embodiments, and thus will not be repeated herein.

The foregoing descriptions are merely optional embodiments of the present disclosure, and are not intended to limit the present disclosure. Within the spirit and principles of the disclosure, any modifications, equivalent substitutions, improvements, or the like are within the protection scope of the present disclosure.

What is claimed is:

1. A method for driving a microfluidic chip, applicable to a device for driving a microfluidic chip, wherein the microfluidic chip comprises a droplet and a plurality of electrodes; the device for driving the microfluidic chip comprises a plurality of switch circuits one-to-one corresponding to the plurality of electrodes, each of the switch circuits having an input connected to the electrode corresponding to the switch circuit, and outputs connected to a first power supply and a second power supply respectively; and the method comprises:

controlling, by a first switch circuit in the plurality of switch circuits, a first electrode connected to the first switch circuit to be electrically connected to the first power supply with the second power supply being disconnected, the first electrode being an electrode currently carrying the droplet;

after controlling the first electrode to be in electrical connection to the first power supply for a first period of time, controlling, by the first switch circuit, the first electrode to be electrically connected to the second power supply with the first power supply being disconnected, and controlling, by a second switch circuit connected to a second electrode, the second electrode to be electrically connected to the first power supply, such that the droplet moves onto the second electrode, the second electrode being an electrode adjacent to the first electrode; and after controlling the first electrode to be in electrical connection to the second power supply for a second period of time, controlling, by the first switch circuit, the first electrode to keep disconnected from both the first power supply and the second power supply respectively, such that part of unreleased charges remains on the first electrode.

2. The method according to claim 1, wherein a period of time within which the first electrode maintains disconnection from the two power supplies is longer than the second period of time.

3. The method according to claim 1, wherein each of the switch circuits is a tri-state switch, and the outputs of each of the switch circuits comprises a first output, a second output and a third output, the first output being connected to the first power supply, the second output being connected to the second power supply, and the third output being idle;

controlling, by the first switch circuit in the plurality of switch circuits, the first electrode connected to the first switch circuit to be electrically connected to the first power supply comprises:

controlling an input of the first switch circuit to be electrically connected to the first output of the first switch circuit;

controlling, by the first switch circuit, the first electrode to be electrically connected to the second power supply comprises:

controlling the input of the first switch circuit to be electrically connected to the second output of the first switch circuit; and controlling, by the first switch circuit, the first electrode to keep disconnected from the two power supplies comprises:

controlling the input of the first switch circuit to be electrically connected to the third output of the first switch circuit.

4. The method according to claim 3, wherein the device for driving the microfluidic chip further comprises a drive circuit connected to each of the switch circuits; and controlling the input of the first switch circuit to be electrically connected to the first output of the first switch circuit comprises:

outputting a first control signal to the first switch circuit by the drive circuit, such that the input of the first switch circuit is electrically connected to the first output of the first switch circuit.

5. The method according to claim 4, controlling the input of the first switch circuit to be electrically connected to the second output of the first switch circuit comprises:

outputting a second control signal to the first switch circuit by the drive circuit, such that the input of the first switch circuit is electrically connected to the second output of the first switch circuit.

6. The method according to claim 4, controlling the input of the first switch circuit to be electrically connected to the third output of the first switch circuit comprises:

outputting a third control signal to the first switch circuit by the drive circuit, such that the input of the first switch circuit is electrically connected to a third output of the first switch circuit.

7. The method according to claim 4, wherein the device for driving the microfluidic chip comprises an upper computer connected to the drive circuit, the upper computer sending drive sequence information to the drive circuit, and the drive sequence information indicating a drive sequence of the plurality of electrodes.

8. The method according to claim 1, wherein a period of time within which the first electrode maintains disconnection from the two power supplies is longer than the first period of time.

9. The method according to claim 1, wherein the first power supply is an AC power supply, and the second power supply is ground.

10. The method according to claim 1, wherein a period of time within which the first electrode maintains disconnection from the two power supplies is longer than the second period of time;

each of the switch circuits is a tri-state switch, the outputs of each of the switch circuits comprising a first output, a second output and a third output, wherein the first output is connected to the first power supply, the second output is connected to the second power supply, and the third output is idle;

controlling, by the first switch circuit in the plurality of switch circuits, the first electrode connected to the first switch circuit to be electrically connected to the first power supply comprises:

controlling an input of the first switch circuit to be electrically connected to the first output of the first switch circuit;

controlling, by the first switch circuit, the first electrode to be electrically connected to the second power supply comprises:

controlling the input of the first switch circuit to be electrically connected to the second output of the first switch circuit;

controlling, by the first switch circuit, the first electrode to keep disconnected from the two power supplies comprises:

controlling the input of the first switch circuit to be electrically connected to the third output of the first switch circuit;

the device for driving the microfluidic chip further comprises a drive circuit connected to each of the switch circuits;

controlling the input of the first switch circuit to be electrically connected to the first output of the first switch circuit comprises:

outputting a first control signal to the first switch circuit by the drive circuit, such that the input of the first switch circuit is electrically connected to the first output of the first switch circuit;

controlling the input of the first switch circuit to be electrically connected to the second output of the first switch circuit comprises:

outputting a second control signal to the first switch circuit by the drive circuit, such that the input of the first switch circuit is electrically connected to the second output of the first switch circuit; and controlling the input of the first switch circuit to be electrically connected to the third output of the first switch circuit comprises:

outputting a third control signal to the first switch circuit by the drive circuit, such that the input of the first switch circuit is electrically connected to the third output of the first switch circuit.

11. A device for driving a microfluidic chip, wherein the microfluidic chip comprises a droplet and a plurality of electrodes; the device comprises a plurality of switch circuits one-to-one corresponding to the plurality of electrodes;

each of the switch circuits has an input connected to the electrode corresponding to the switch circuit, and outputs connected to a first power supply and a second power supply respectively; and each of the switch circuits is configured to control an electrode connected thereto; to be electrically connected to the first power supply with the second power supply being disconnected, to be electrically connected to the second power supply with the first power supply being disconnected, and to keep disconnected from both the first power supply and the second power supply, such that part of unreleased charges remains on the first electrode; and wherein voltage of the first power supply is higher than that of the second power supply.

12. The device according to claim 11, wherein each of the switch circuits is a tri-state switch, the outputs of each of the switch circuits comprising a first output, a second output and a third output, wherein the first output is connected to the first power supply, the second output is connected to the second power supply, and the third output is idle.

13. The device according to claim 12, further comprising a drive circuit connected to each of the switch circuits, wherein the drive circuit is configured to output a first control signal, a second control signal or a third control signal to each of the switch circuits, the first control signal being configured to instruct the switch circuit to electrically connect the input of the switch circuit with the first output of the switch circuit, the second control signal being configured to instruct the switch circuit to electrically connect the input of the switch circuit with the second output of the switch circuit, and the third control signal being configured to instruct the switch circuit to electrically connect the input of the switch circuit with the third output of the switch circuit.

14. The device according to claim 13, further comprising an upper computer connected to the drive circuit, wherein the upper computer sends drive sequence information to the drive circuit, and the drive sequence information indicates a drive sequence of the plurality of electrodes.

15. The device according to claim 13, wherein the drive circuit is a single-chip microcomputer.

16. The device according to claim 11, wherein each of the switch circuits is a tri-state switch, and the outputs of each of the switch circuits comprise a first output, a second output and a third output, the first output being connected to the first power supply, the second output being connected to the second power supply, and the third output being idle;

the device comprises a drive circuit connected to each of the switch circuits, the drive circuit being a single-chip microcomputer, wherein the drive circuit is configured to output a first control signal, a second control signal or a third control signal to each of the switch circuits, the first control signal being configured to instruct the switch circuit to electrically connect the input of the switch circuit with the first output of the switch circuit, the second control signal being configured to instruct the switch circuit to electrically connect the input of the switch circuit with the second output of the switch circuit, and the third control signal being configured to instruct the switch circuit to electrically conned the input of the switch circuit with the third output of the switch circuit.

17. A microfluidic system, comprising a microfluidic chip and the device for driving the microfluidic chip as defined in claim 11.

18. The system according to claim 17, each of the switch circuits of the device is a tri-state switch, the outputs of each of the switch circuits comprising a first output, a second output and a third output, wherein the first output is connected to the first power supply, the second output is connected to the second power supply, and the third output is idle.

19. The system according to claim 18, wherein the device further comprises a drive circuit connected to each of the switch circuits, wherein the drive circuit is configured to output a first control signal, a second control signal or a third control signal to each of the switch circuits, the first control signal being configured to instruct the switch circuit to electrically connect the input of the switch circuit with the first output of the switch circuit, the second control signal being configured to instruct the switch circuit to electrically connect the input of the switch circuit with the second output of the switch circuit, and the third control signal being configured to instruct the switch circuit to electrically connect the input of the switch circuit with the third output of the switch circuit.

20. The system according to claim 17, wherein each of the switch circuits of the device is a tri-state switch, and the outputs of each of the switch circuits comprise a first output, a second output and a third output, the first output being connected to the first power supply, the second output being connected to the second power supply, and the third output being idle;

the device comprises a drive circuit connected to each of the switch circuits, the drive circuit being a single-chip microcomputer, wherein the drive circuit is configured to output a first control signal, a second control signal or a third control signal to each of the switch circuits, the first control signal being configured to instruct the switch circuit to electrically connect the input of the switch circuit with the first output of the switch circuit, the second control signal being configured to instruct the switch circuit to electrically connect the input of the switch circuit with the second output of the switch circuit, and the third control signal being configured to instruct the switch circuit to electrically connect the input of the switch circuit with the third output of the switch circuit.

* * * * *